US011473317B2

(12) United States Patent
Snyder

(10) Patent No.: US 11,473,317 B2
(45) Date of Patent: Oct. 18, 2022

(54) NON-RUSTING AND FLUSH BOTTOM POLYMER POWER TROWEL BLADE

(71) Applicant: Jeffrey Lynn Snyder, York, PA (US)

(72) Inventor: Jeffrey Lynn Snyder, York, PA (US)

( * ) Notice: Subject to any disclaimer, the term of this patent is extended or adjusted under 35 U.S.C. 154(b) by 268 days.

(21) Appl. No.: 16/733,315

(22) Filed: Jan. 3, 2020

(65) Prior Publication Data

US 2020/0217089 A1 Jul. 9, 2020

Related U.S. Application Data

(60) Provisional application No. 62/790,272, filed on Jan. 9, 2019.

(51) Int. Cl.
*E01C 19/42* (2006.01)
*E04F 21/24* (2006.01)

(52) U.S. Cl.
CPC ..... *E04F 21/245* (2013.01); *E01C 19/42* (2013.01)

(58) Field of Classification Search
CPC ..... E04F 21/245; E01C 19/42
USPC ..... 404/112
See application file for complete search history.

(56) References Cited

U.S. PATENT DOCUMENTS 2,048,529 A * 7/1936 Williams ..... E04F 21/06 15/235.5
2,667,824 A * 2/1954 McCrery ..... E04F 21/248 404/112
3,375,766 A * 4/1968 Zochil ..... E04F 21/245 404/112
4,397,581 A * 8/1983 Jarvis ..... E06B 7/2307 15/235.4
5,372,452 A * 12/1994 Hodgson ..... E04F 21/248 404/112
6,250,844 B1 * 6/2001 Sartler ..... E04F 21/247 404/112
6,648,548 B2 * 11/2003 Kelsay, III ..... E04F 21/248 404/112
7,255,513 B2 * 8/2007 Lampley ..... E04F 21/245 404/112
10,100,537 B1 * 10/2018 Guinn ..... E01C 19/42
2005/0141962 A1 * 6/2005 Snyder ..... E04F 21/247 404/112
2006/0137125 A1 * 6/2006 Goller ..... E04F 21/163 15/235.4
2008/0025794 A1 * 1/2008 Barcenas ..... E04F 21/248 404/112
2015/0159384 A1 * 6/2015 Wetherell ..... E04F 21/245 404/112
2017/0292232 A1 * 10/2017 Marsolek ..... E01C 23/14

* cited by examiner

*Primary Examiner* — Raymond W Addie
(74) *Attorney, Agent, or Firm* — Potomac Law Group, PLLC

(57) ABSTRACT

A power trowel blade that is made of non-rusting solid component material for use with a power trowel apparatus. The trowel blade include a mounting surface and an oppositely facing finishing surface. The finishing surface is flush and free of voids or protrusions. The flush finishing surface prevents surface material being collected as the trowel blade is used to finish surfaces to a hard finish.

17 Claims, 6 Drawing Sheets

NON-RUSTING AND FLUSH BOTTOM POLYMER POWER TROWEL BLADE

FIELD OF THE INVENTION

The present invention is directed to a power trowel blade. In particular, the invention relates to power trowel blade with a flush bottom which does not damage the finish of the surface on which the power trowel blades are used.

BACKGROUND OF THE INVENTION

Power trowel machines use three typical types of trowel blades: float blades, finish blades, and combination blades. Trowel blades can be used on concrete, epoxy, polymer or other materials. Float blades are used while particles can be easily moved within itself. Float blades are typically rectangular, ten inches wide and have all four sides bent up or beveled so as to not dig into the fresh material (concrete). The length and width of blades depend on the make and model of the equipment and the style of the blade. Float blades are used early in the process and run mostly flat to prepare the surface for the finishing stage. Float blades are typically made from low carbon steel. The vibration of the power device helps embed the heavier larger particles which bring the smaller particles to the surface due to the specific gravity of particles.

Finish blades are used in the finishing stage. Finish blades are used after the floating process. During the finishing process finish blades are pitched to put pressure on the surface to consolidate fines to produce a dense surface.

Sometimes for convenience a single blade is desired to float and finish with the same blade referred to as a combination blade. Combination blades can be used during the float or finish stages and have some characteristics of both float and finish blades as the name implies.

Typical finish and combination blades are assembled with a screw, bolt, rivet, or other fastener to connect the blade to the mounting bar or channel. Typically, the blade is made of high carbon steel which can leave dark burn marks. Plastic blades are known to be used to avoid dark burn marks and until now have had a metal bar or channel for connecting onto the trowel arm. One such metal plate reinforced plastic trowel blade for power troweling is shown in U.S. Pat. No. 7,059,801 B2. Another blade is shown in U.S. Pat. No. 4,556,339. In such blades, the bolts or screws, which are installed from the bottom, can be difficult to remove after the blade is used as concrete can fill the void in the head of the bolt or screw and harden before it is removed.

In known poly blades, the plastic blade material is mechanically fastened to a bar or channel mounting component. The plastic blade material is counter sunk or counter bored to allow room for the bolt or screw to be out of the way from potential contact to the surface being finished. The bolt or screw can become loose and back out of the bar. Voids in the plastic material becomes a place for concrete material to accumulate and harden. This accumulation can later be a problem if it falls out during the finishing process. The particles can fall out and can scratch or mar the surface being finished. In addition, metal plate reinforced plastic blades and non-metal plate plastic blades typically use a steel bar or channel that can rust.

Another problem with known blades is that completely flat rigid ends can cause trowel or chatter marks. As the equipment is used the rotors move to steer. This movement puts pressure onto the ends of the blades, causing the blade to leave undesired trowel marks. In addition, chatter marks can be created on the surface if the blade is pitched too early.

SUMMARY OF THE INVENTION

An object is to provide a continuous or flush bottom trowel blade that does not have any voids, protrusions, rivets, screws or bolts.

An object is to provide to provide a trowel blade that allows for a slight curve in the material of the blade to avoid digging in of the ends of the blades, thereby minimizing trowel marks in the finished surface.

An object is to provide a trowel blade which reduces or eliminates the need for an additional bar for support, thereby eliminating the need to have a separate mounting component which extends through the bottom of the blade.

An object is to provide a trowel blade which is made from plastic material which can be fabricated, molded, injection molded, 3D printed, or made using other known methods.

An object is to provide a trowel blade which allows for finishing without transferring carbon into the finish surface material.

An object is to provide a trowel blade that uses threaded inserts made from non-ferrous materials and plastic blade material which allows for the entire blade assembly to be completely non-rusting.

An object is to provide a trowel blade that a recess on the ends of the blade space for the equipment arms with pivot connector of the power trowel.

An object is to provide a trowel blade that does not need an additional bar or channel.

An object is to provide a trowel blade that has additional flex to help avoid chatter marks.

An embodiment is directed to a trowel blade for use with a power trowel apparatus. The trowel blade include a mounting surface and an oppositely facing finishing surface. The finishing surface is flush and free of voids or protrusions. The flush finishing surface prevents surface material being collected as the trowel blade is used to finish surfaces to a hard finish.

An embodiment is directed to a single piece trowel blade for use with a power trowel apparatus. The single piece trowel blade includes a mounting surface and an oppositely facing finishing surface. The finishing surface is flush and free of voids or protrusions. The finishing surface has curved portions proximate the ends of the trowel blade. Mounting openings extend from the mounting surface toward the finishing surface. Recesses are provided on either side of a main body portion of the trowel blade. The main body portion extends from the mounting surface to the finishing surface. The recesses extend from the main body portion to ends of the trowel blade, and extend from the mounting surface toward the finishing surface. The flush finishing surface prevents surface material being collected as the trowel blade is used to finish surfaces to a hard finish.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
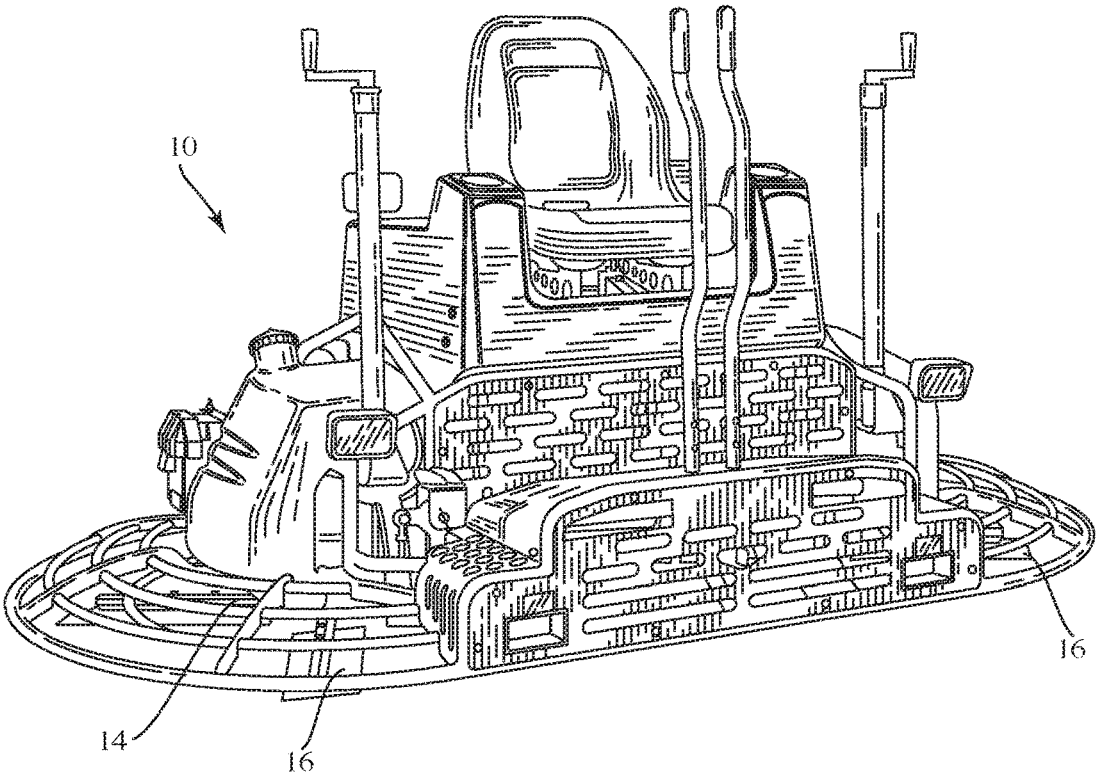
Figure 1 Prior Art
FIG. 1 is a perspective view of a known ride-on type power trowel.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
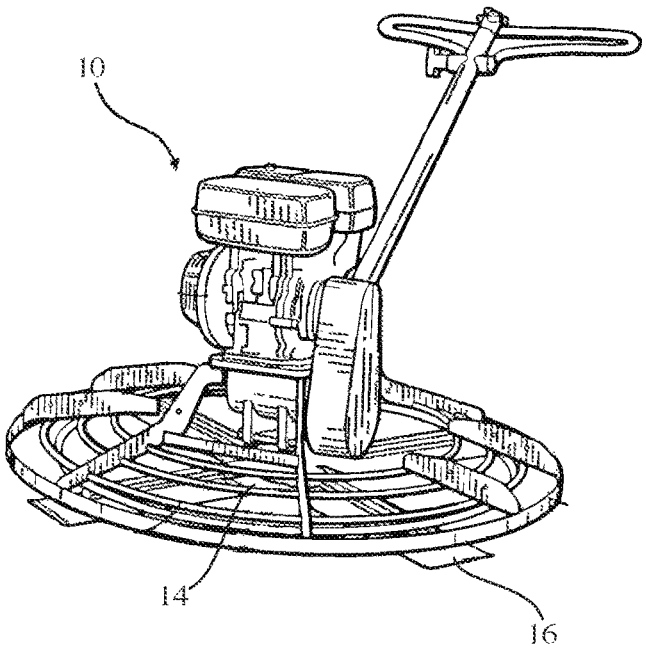
Figure 2 Prior Art
FIG. 2 is a perspective view of a known walk-behind type power trowel.
Figure 3:
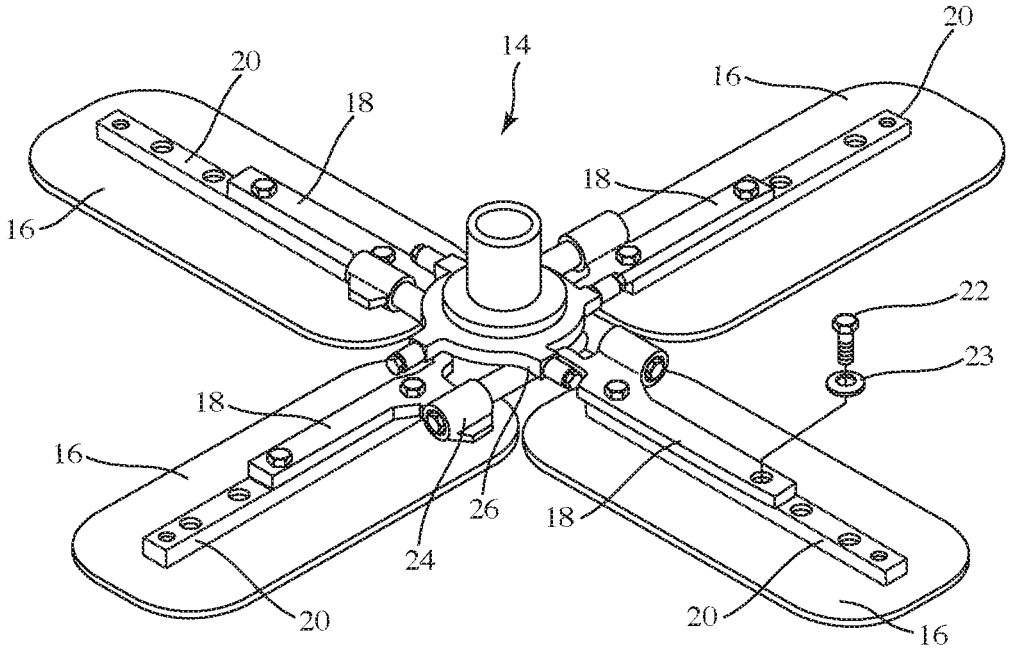
Prior Art Figure 3
FIG. 3 is a perspective view of a spider assembly of a power trowel with trowel blades attached.

Power trowels, as illustrated by apparatus 10 in FIG. 1 and apparatus 12 is FIG. 2, are often used to finish concrete, epoxy, terrazzo or other co-polymer surfaces to a hard finish. The power trowel may be a ride-on type power trowel 10, as illustrated in FIG. 1 or a walk-behind power trowel 12, as illustrated in FIG. 2. The power trowels 10, 12 include a spider assembly 14 with power trowel blades 16. As shown in FIG. 3, illustrative versions of the spider assembly 14 may have 3 to 6 trowel arms 18 depending on the make and model of equipment. The trowel blades 16 are attach to the trowel arms 18. Conventional trowel blades 16 have metal bars or channels 20 that are connected to the trowel blade 16. The metals bars 20 are mounted to the trowel arms 18 by hardware 22, which may include a lock washer or conical spring washer 23, as shown in FIG. 3.

The spider assembly 14 may include a pivot connector 24 proximate the rotating shaft 26 of the spider assembly. The operation of the spider assembly 14, the pivot connector 24 and the rotating shaft 26 are known in the industry.

The trowel blades 16 may be float blades, finish blades or combination blades as previously described. Finish blades are typically approximately 6 inches wide, while combination blades are typically approximately 8 inches.

Referring to FIGS. 4 through 7, an illustrative embodiment of the trowel blade 30 according to the present invention is shown. The trowel blade 30 has a top or mounting surface 32 and an oppositely facing second or finishing surface 34. The trowel blade 30 is made from a non-rusting polymer or other material having the finishing and strength characteristics desired.

The non-rusting polymer material may be made of, for example, formed ultra-high molecular weight polyethylene (UHMWPE) or good wear resistant injection molded plastic. The trowel blade 30 may be manufactured in a single piece using various methods, including, but not limited to, injection molding, additive printing and 3D printing. In illustrative embodiment of the trowel blade 30, the length of the trowel blade 30 may range from 9 inches to 23 inches, the width may range from 4.75 to 10 inches and the thickness may range from 0.5 inches to 1.5 inches with the preferred thickness being 1.0 inches. Density of the UHMWPE plastic may range from 0.93 gm/cm3 to 0.96 gm/cm3.

Figure 4:
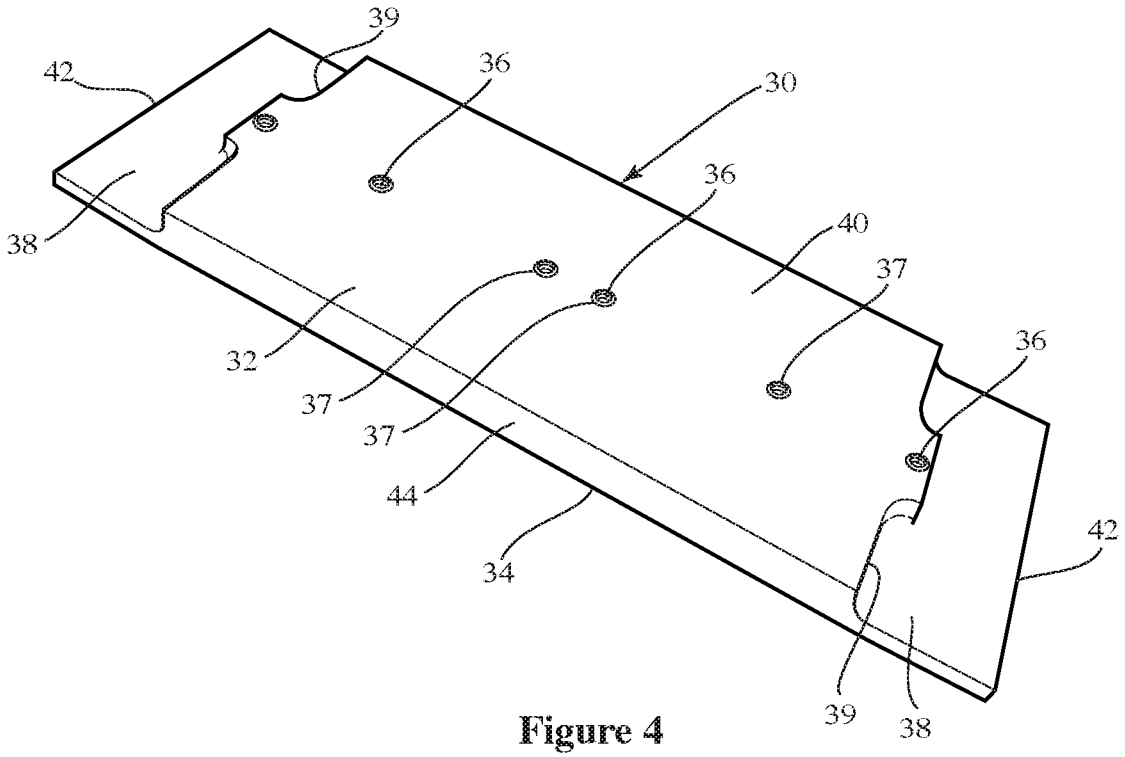
FIG. 4 is a top perspective view of an illustrative embodiment of a trowel blade according to the present invention.
Figure 7:
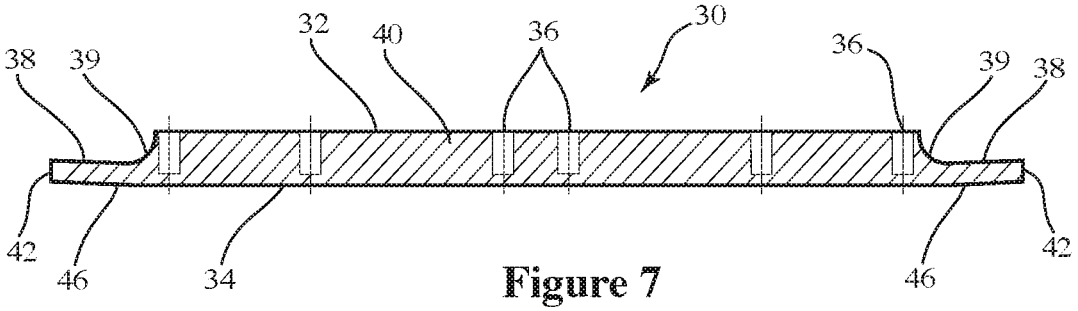
FIG. 7 is a cross-sectional view of the trowel blade of FIG. 4, taken along the longitudinal axis of the trowel blade.

As shown in FIG. 4, the mounting surface 32 has mounting openings 36 which extend from the mounting surface 32 toward the finishing surface 34. However, in this illustrative embodiment, as shown in FIG. 7, the mounting openings 36 do not extend through the finishing surface 34. The mounting openings 36 may be threaded to accept the mounting hardware 22 therein.

Alternatively, as shown in FIG. 4, the mounting openings 36 may have mounting inserts 37 provided therein for receiving the mounting hardware 22 of the trowel arms 18. In various illustrative embodiments, the trowel blade 30 may be overmolded over the mounting inserts 37 to secure the mounting inserts 37 to the trowel blade 30. In other illustrative embodiments, the mounting inserts 37 may be secured in the mounting openings 36 by adhesive or other known methods of attachment. The mounting inserts 37 are made of a non-rusting material. The internal thread size of the mounting inserts 37 depends on the make and model of equipment to which the trowel blade 30 is to be mounted. Typical mounting inserts 37 internal diameters can range from 0.25 to 0.0.875 inches. Illustrative mounting inserts 37 depths may range from 0.25 to 1.0 inches. In other embodiments, the mounting inserts 37 may also be made to accept other types of hardware or fasteners.

In the embodiment shown, the mounting openings 36 are positioned in line with the longitudinal axis of the trowel blade 30. However, the mounting openings 36 may also be positioned off center from the longitudinal axis of the trowel blade 30.

Recesses 38 are provided on either side of the main body portion 40 of the trowel blade 30. The recesses 38 extend from end walls 39 of the main body portion 40 to the ends 42 of the trowel blade 30. The recesses 38 extend from the mounting surface 32 toward the finishing surface 34. The end walls 39 may be straight or may have an arcuate to curved configuration. The recesses 38 provide clearance for the pivot connector 24 of the spider assembly 14 as the trowel blade 30 is mounted to the trowel arm 18. In the illustrative embodiment shown, the length of the main body portion 40 exclusive of the recesses 38 may be 60-80 percent of the length of the trowel arm 30. Second recesses (not shown) may also extend from the main body portion 40 to side walls 44 of the trowel blade 30. The width of the main body portion 40 exclusive of the second recesses may be 70-100 percent of the width of the trowel arm 30.

Figure 5:
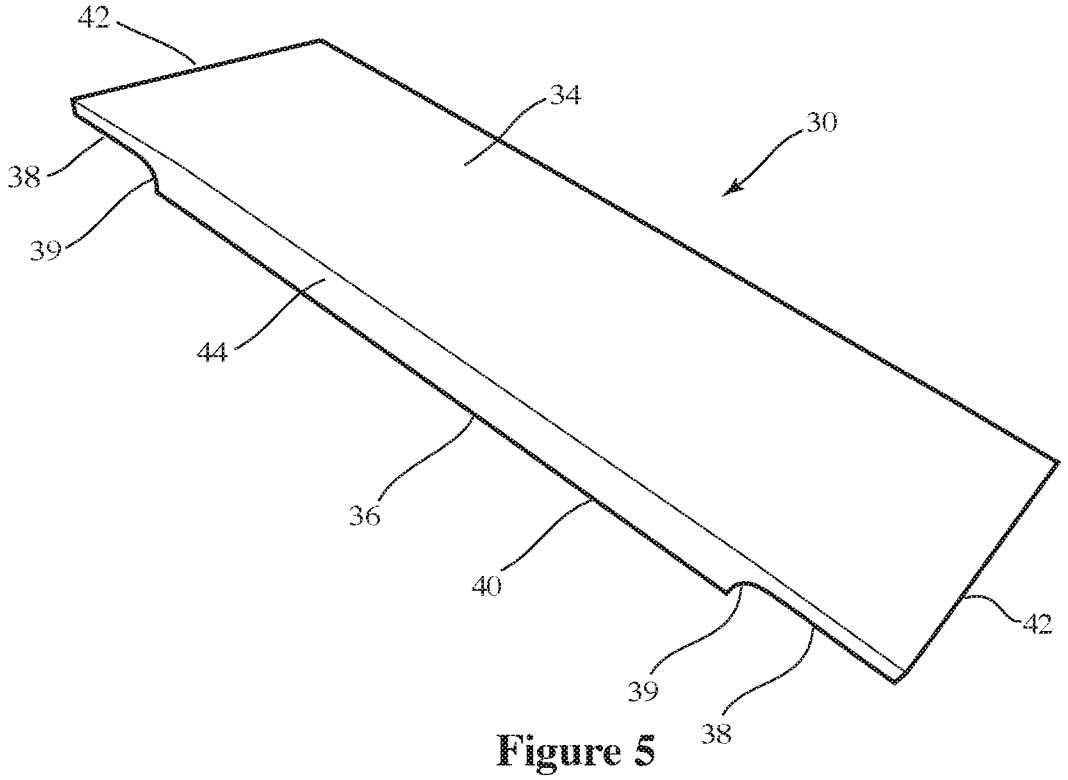
FIG. 5 is a bottom perspective view of the trowel blade of FIG. 4.

The finish surface 34, as shown in FIG. 5, is a continuous or flush surface with no protrusions or voids provided thereon. This eliminates the possibility of material being disturbed or collected in the voids as the trowel blades 30 are used to finish concrete, epoxy, terrazzo or other co-polymer surfaces to a hard finish.

Figure 6:
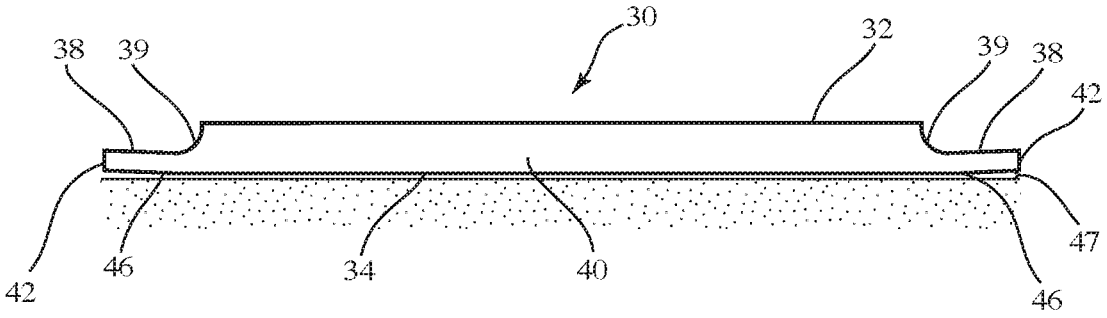
FIG. 6 is a side view of the trowel blade of FIG. 4.

As shown in FIG. 6, the flush finish surface 34 may have curved portions 46, with a slight curve or bevel, proximate the ends 42 of the trowel blade 30. In the illustrative embodiment the curve may have an angle 47 of between 0 degrees to 20 degrees.

Figure 8:
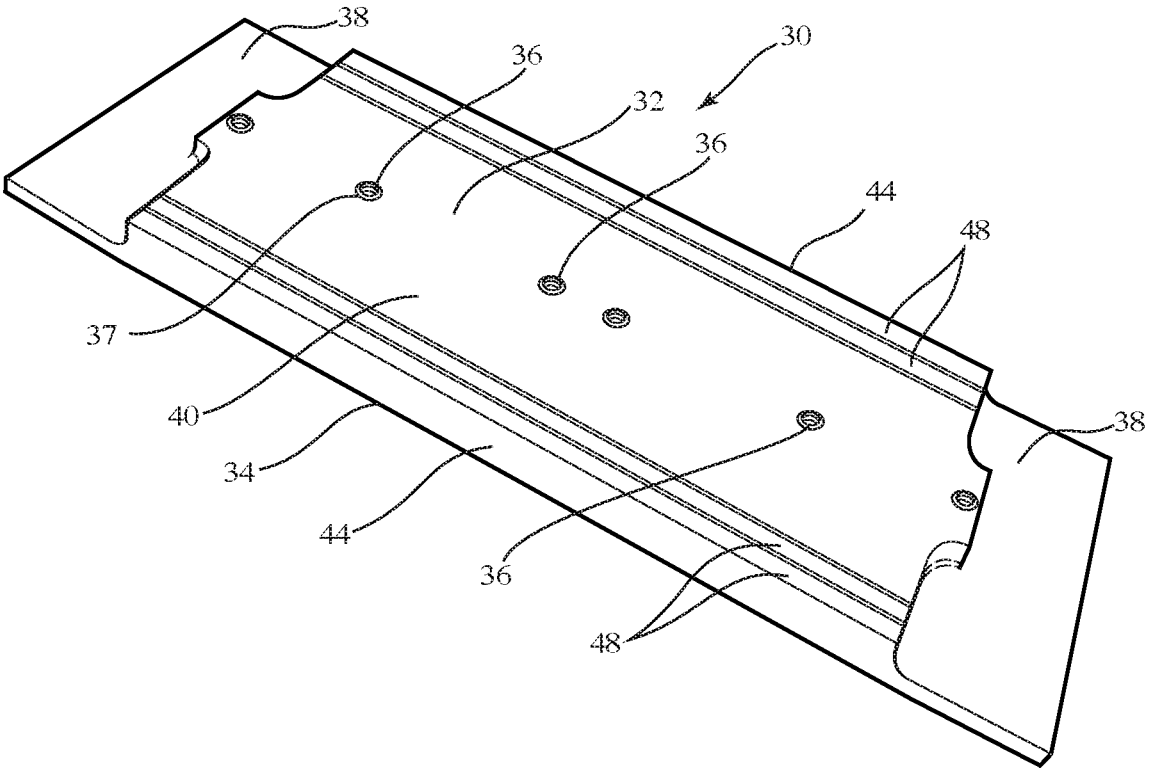
FIG. 8 is a top perspective view of a first alternate illustrative embodiment of a trowel blade according to the present invention.
Figure 9:
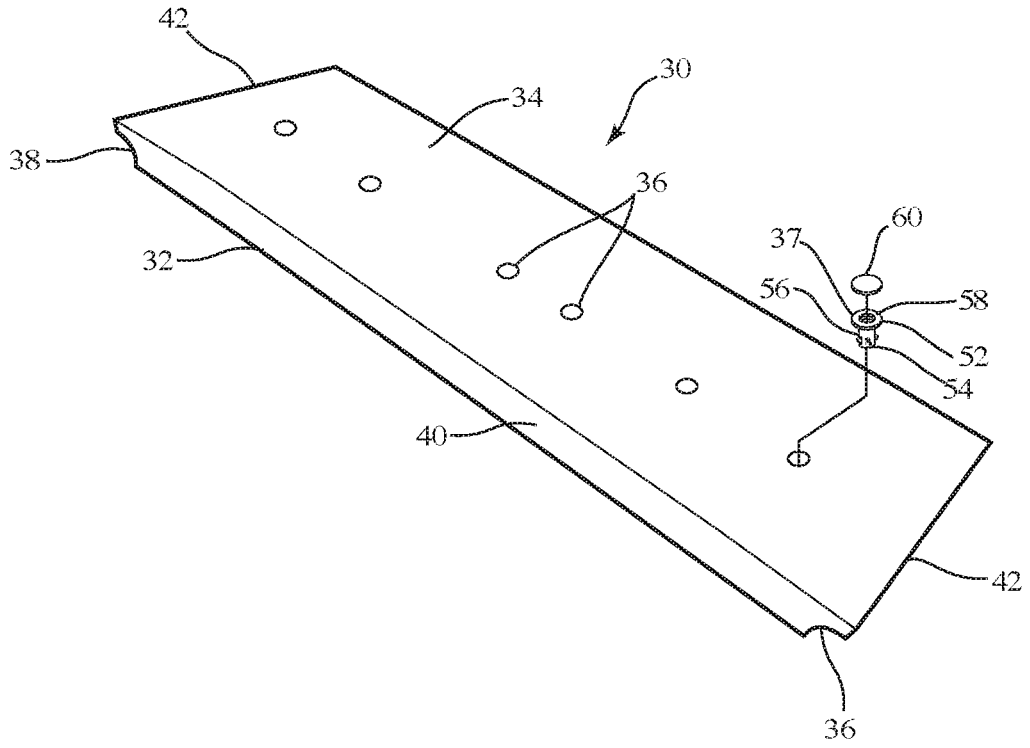
FIG. 9 is a bottom perspective view of a second alternate illustrative embodiment of a trowel blade according to the present invention.

Referring to FIG. 8, an alternate embodiment of the power trowel blade 30 is shown. In this embodiment, recesses or cavities 48 are formed or cut into the mounting surface 32 of the trowel blade 30. The cavities 48 extend from the mounting surface 32 toward the finishing surface 34. One or more cavities 48 may be provided. In the embodiment shown, two cavities 48 are provided in the main body portion 40 proximate the side walls 44. The cavities 48 extend the length of the main body portion 40 in a direction which is essentially parallel to the side walls 44. The cavities 48 allow for a space with allows the main body portion 40 and the trowel blade 30 to flex or close on itself when pressure is applied to areas of the finishing surface 34 proximate the side walls 44. This allows the finishing surface 34 of the trowel blade 30 to better conform to the hard surface on which the trowel blade 30 acts, thereby minimizing or preventing the trowel blade 30 from leaving chatter marks on the hard surface.

If a stiffer trowel blade 30 is desired, an attachable clip (not shown) with ribs may be positioned on the main body portion 40 of the trowel blade 30. The ribs enter the cavities 48, preventing the cavities 48 to flex or close on itself when pressure is applied to areas of the finishing surface 34 proximate the side walls 44, thereby making the trowel blade 30 stiffer.

Figure 10:
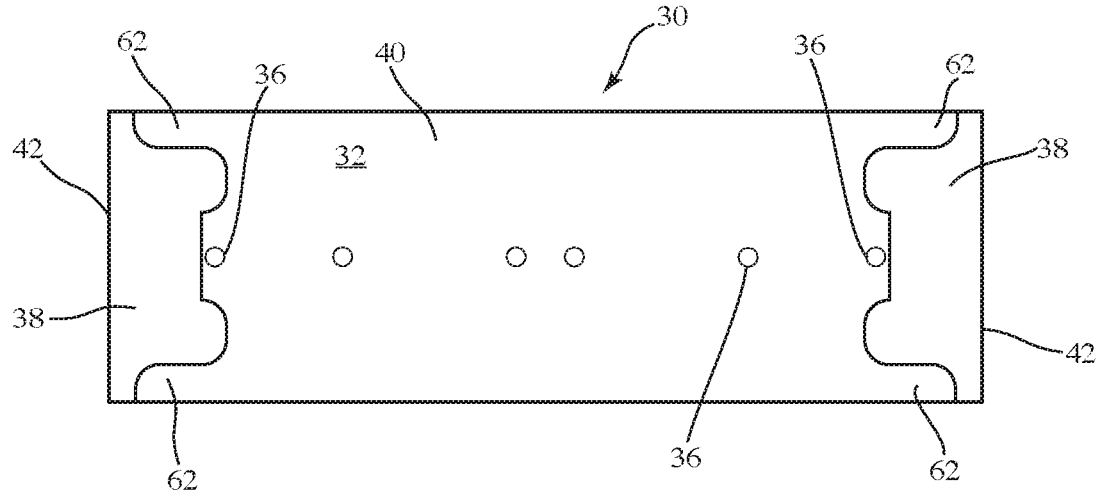
FIG. 10 is a top view of the trowel blade of FIG. 9.
Figure 11:
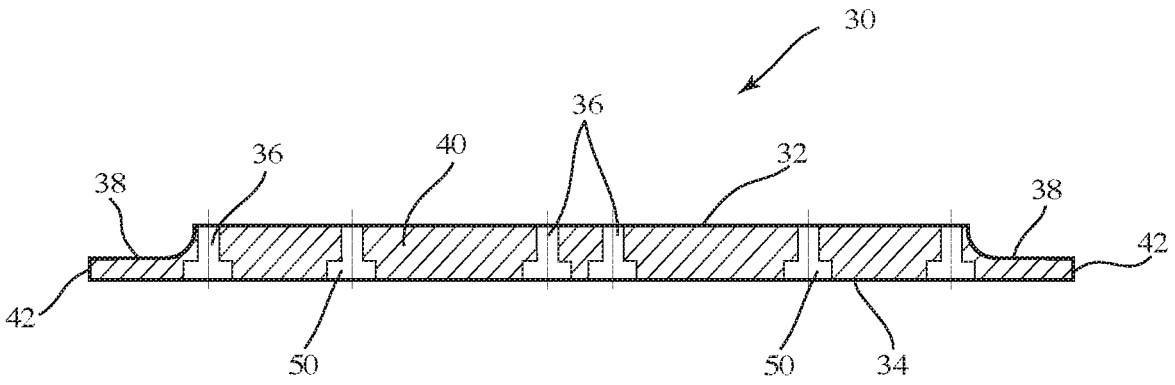
FIG. 11 is a cross-sectional view of the trowel blade of FIG. 9, taken along the longitudinal axis of the trowel blade.

FIGS. 9 through 12 illustrate another illustrative embodiment of the trowel blade 30. In this embodiment, the mounting openings 36 extend from the mounting surface 32 through the finishing surface 34, as shown in FIG. 11. The mounting openings 36 have an enlarged portion 50 provided proximate the finishing surface 34. The mounting inserts 37 (FIG. 9), which are inserted into the mounting openings 36 through the finishing surface 34, have an enlarged portions 52 and mounting portions 54. The mounting portions 54 have projections or barbs 56 which project outward from the mounting portions 54. When inserted, the enlarged portions 52 of the mounting inserts 37 are positioned in the enlarged portions 50 of the mounting openings 36. In this position, the free ends 58 of the enlarged portions 52 of the mounting inserts 37 are positioned fully in the enlarged portions 50 of the mounting openings 36, such that the free ends 58 do not project past the finishing surface 34. The barbs 56 cooperate with the walls of the mounting opening 36 to retain that mounting inserts 37 in the mounting openings 36.

Plugs or covers 60 are provided in the mounting openings 36 after the mounting inserts 37 are properly positioned. The covers 60 are made of water resistant material, which may be the same material as the trowel blade 30. The covers 60 are retained in the mounting openings 36 by adhesive or other known securing methods. The covers 60 are dimensioned to have a diameter which is essentially equal to the diameter of the enlarged portions 50 of the mounting openings 36, thereby allowing the covers 60 to affect a snug connection to the mounting openings 36 to prevent debris or material from entering the mounting openings 36.

As shown in FIG. 10, the shape of the recesses 38 are different that the recesses 38 shown in FIGS. 4 and 8. The recesses 38 of FIG. 10 have strengthening legs 62 which are provided proximate side walls 44 and extend from the main body portion 40 toward the ends 42. The strengthening legs 62 strengthens or stiffens the finishing surface 34 and the trowel blade 30.

Figure 12:
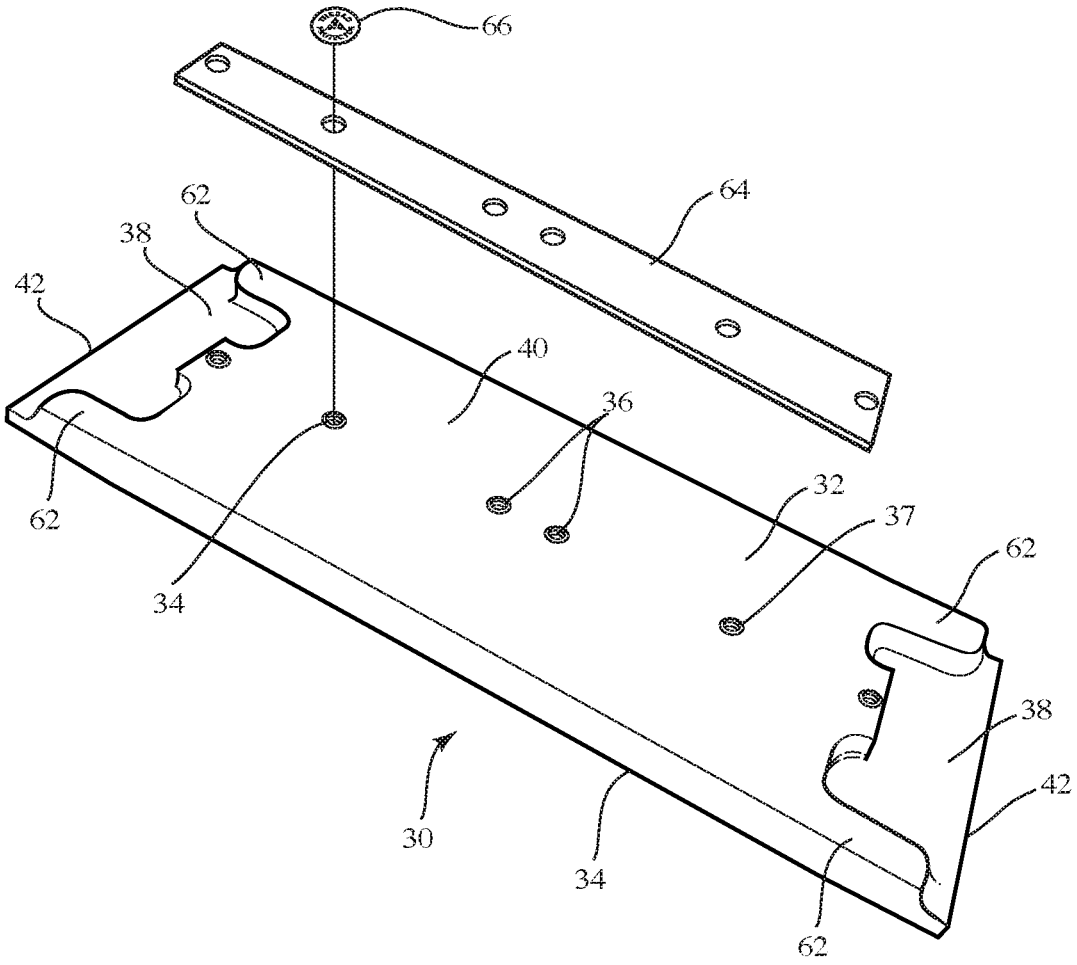
FIG. 12 is a top perspective view of the trowel blade of FIG. 9 with a pitch plate exploded therefrom.

As shown in FIG. 12, the trowel blade 30 may be provided with a pitch plate 64 for protecting the main body portion 40 of the trowel blade 30 by keeping trowel arm 18 from depressing into the polymer material of the main body portion 40. As the weight and operation of the power trowel puts force on main body portion 40 of the trowel blade 30, the strength and rigidity of the pitch plate 64 spreads the force or load of the trowel arm 18 over a larger area of the main body portion 40 of the trowel blade 30 to avoid depressing the polymer material around the mounting openings 36 that could then cause the mounting hardware 22 to come loose. The pitch plate 64 may be made from a variety of materials, such as, but not limited to, non-corrosive steel. The width of the pitch plate 64 is at least as wide as the trowel arm 18 to approximate 30 percent of the width of the main body portion 40. The length of the pitch plate 64 extends at least the length of the trowel arm 18 with a maximum length of the pitch plate 64 equal to the length of the main body portion 40 aligned with the mounting openings 36.

Mounting opening protective covers 66 are shown in FIG. 12. The mounting opening protective covers 66 are positioned over one or more mounting openings 36. The mounting opening protective covers 66 prevent unwanted material or debris from entering the mounting openings 36 which do not have mounting hardware 22 inserted therein. The mounting opening protective covers 66 are made of water resistant material, Each mounting opening protective cover 66 may be punctured or broken when the mounting hardware 22 is positioned in the respective mounting opening 36.

Known power trowel blades have rivets, screws, or bolts that go thru the bottom of the blade for connecting onto a bar or channel for mounting. Surface material can collect in the voids and later vibrate out which may cause scratching. In contrast, the trowel blades 30 of the present invention are made from one piece which is thick enough to use mounting inserts 37 in lieu of connector bar or channel, thereby allowing the finishing surface 34 to be continuous or flush and fee of protrusions or voids.

Known power trowel blades have rivets, screws, or bolts that can fail by loosening or shearing, causing the blade to come apart from the bar or channel. In contrast, the trowel blades 30 of the present invention are made from one piece so there is no fastener needed to secure the blade to a mounting bar or channel.

Power trowels are used in an environment that would promote oxidation or rust on materials containing ferrous materials. Known power trowel blades are typically made of a ferrous metal or have a ferrous metal connector mount that will rust. In contrast, the trowel blades 30 of the present invention are made from non-rusting plastic material and non-rusting inserts for mounting onto the trowel arm.

Known power trowel blades with a steel blade cause dark burnish marks on the surface being finished which is not always aesthetically desired. In contrast, the trowel blades 30 of the present invention are made from a polymer material that does not leave dark burn marks on the finished surface and thus can be used to control the amount of dark burn marks.

Power trowel blades need room on the end of the blade for a lift lever or pivot connector on the trowel arm. The trowel blades 30 of the present invention have recesses 38 for clearance at the ends 42 of the mounting surface 32 to accommodate the pivot connector 24.

In known power trowel blades, the corners of blade can cause trowel marks. In particular, as the spider assembly 14 pivots to steer the power trowel apparatus, the pressure applied to the trowel blade can be greater on the corners. The trowel blades 30 of the present invention have slight curves 46 on ends 42 thereby avoids trowel marks. In addition, the trowel blades 30 have recesses 38 at the ends 42, whereby the ends of the trowel blades 30 have less material thickness than the main body portion 40. Less material thickness on the ends 42 allow for more flexibility at the ends 42, thereby decreasing the risk of trowel marks.

It is sometimes desirable to have some flex on the trailing edge of the trowel blade to avoid chatter marks. The power trowel blade of the present invention can be easily cut on the trailing edge with saw cuts or molded with cavities to provide a void proximate the mounting surface 32 to allow space to close together allowing for more flex. A separate piece can be inserted into the voids to make the blade more rigid.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

I claim:

1. A trowel blade for use with a power trowel apparatus, the trowel blade comprising:

a mounting surface;

an oppositely facing finishing surface, the finishing surface being flush and free of voids or protrusions;

the mounting surface having mounting openings, the mounting openings do not extend through the finishing surface, the mounting openings have mounting inserts provided therein for receiving mounting hardware of a trowel arm of the power trowel apparatus, the mounting inserts are made of a non-rusting material;

wherein the flush finishing surface prevents surface material being collected as the trowel blade is used to finish surfaces to a hard finish.

2. The trowel blade as recited in claim 1, wherein the trowel blade is made from a non-rusting polymer.

3. The trowel blade as recited in claim 1, wherein the trowel blade is manufactured as a single piece.

4. The trowel blade as recited in claim 1, wherein the trowel blade is overmolded over the mounting inserts to secure the mounting inserts to the trowel blade.

5. The trowel blade as recited in claim 1, wherein the flush finishing surface has curved portions proximate ends of the trowel blade.

6. The trowel blade as recited in claim 1, wherein recesses are provided on either side of a main body portion of the trowel blade, the recesses extend from the main body portion to ends of the trowel blade, the recesses extend from the mounting surface toward the finishing surface.

7. The trowel blade as recited in claim 6, wherein the recesses have strengthening legs which are provided proximate side walls of the trowel blade and extend from the main body portion toward the ends.

8. The trowel blade as recited in claim 6, wherein a pitch plate is provided on the main body portion of the trowel blade to prevent a trowel arm of the power trowel apparatus from damaging the main body portion.

9. The trowel blade as recited in claim 6, wherein at least one cavity is provided in the mounting surface, the at least one cavity extends the length of the main body portion in a direction which is parallel to side walls of the trowel blade, the cavities provide a space which allows the main body portion and the trowel blade to flex or close on itself when pressure is applied to areas of the finishing surface proximate the side walls.

10. The trowel blade as recited in claim 9, wherein the at least one cavity extends in a direction which is parallel to side walls of the trowel blade.

11. The trowel blade as recited in claim 9, wherein an attachable clip with ribs is positioned on the main body portion of the trowel blade, the ribs being configured to enter the cavities, preventing the cavities to flex or close on itself when pressure is applied to the areas of the finishing surface proximate the side walls.

12. A trowel blade for use with a power trowel apparatus, the trowel blade comprising:

a mounting surface;

an oppositely facing finishing surface;

mounting openings extend from the mounting surface through the finishing surface, the mounting openings have an enlarged portion provided proximate the finishing surface, mounting inserts are inserted into the mounting openings through the finishing surface, the mounting inserts have insert enlarged portions and insert mounting portions, free ends of the insert enlarged portions do not project past the finishing surface.

13. The trowel blade as recited in claim 12, wherein covers are provided in the mounting openings after the mounting inserts are properly positioned.

14. A single piece trowel blade for use with a power trowel apparatus, the single piece trowel blade comprising:

a mounting surface;

an oppositely facing finishing surface, the finishing surface being flush and free of voids or protrusions, the finishing surface having curved portions proximate the ends of the trowel blade;

mounting openings extending from the mounting surface toward the finishing surface;

recesses provided on either side of a main body portion of the trowel blade, the main body portion extending from the mounting surface to the finishing surface, the recesses extending from the main body portion to ends of the trowel blade, the recesses extending from the mounting surface toward the finishing surface;

wherein the flush finishing surface prevents surface material being collected as the trowel blade is used to finish surfaces to a hard finish.

15. The single piece trowel blade as recited in claim 14, wherein the mounting openings have mounting inserts provided therein for receiving mounting hardware of a trowel arm of the power trowel apparatus.

16. The trowel blade as recited in claim 14, wherein at least one cavity is provided in the mounting surface, the at least one cavity extends the length of the main body portion in a direction which is parallel to side walls of the trowel blade, the cavities provide a space which allows the main body portion and the trowel blade to flex or close on itself when pressure is applied to areas of the finishing surface proximate the side walls.

17. The trowel blade as recited in claim 14, wherein the recesses have strengthening legs which are provided proximate side walls of the trowel blade and extend from the main body portion toward the ends.

* * * * *